United States Patent [19]

Semmler et al.

[11] Patent Number: 4,631,766

[45] Date of Patent: Dec. 30, 1986

[54] NEONATAL INFANT SEAT

[75] Inventors: Caryl J. Semmler; Carol A. Cook, both of Dallas; Jackie D. Smith, Lewisville, all of Tex.

[73] Assignee: Board of Regents, The University of Texas System, Austin, Tex.

[21] Appl. No.: 705,732

[22] Filed: Feb. 25, 1985

[51] Int. Cl.[4] ..... A47D 13/00

[52] U.S. Cl. ..... 5/431; 5/436; 297/458; 297/460; 297/DIG. 2

[58] Field of Search ..... 5/431, 434, 436, 443; 128/134; 297/458, 459, 460, DIG. 1, DIG. 2

[56] References Cited

U.S. PATENT DOCUMENTS

| | | | |
|---|---|---|---|
| Re. 24,377 | 10/1957 | Creelman | 5/436 X |
| 2,281,629 | 5/1942 | Snow | 5/431 |
| 3,038,175 | 6/1962 | Faget et al. | 5/431 X |
| 3,729,752 | 5/1973 | Huggins | 128/134 X |
| 3,843,980 | 10/1974 | Rodriguez | 5/431 X |
| 4,359,045 | 11/1982 | Cozzi | 5/431 X |
| 4,383,713 | 5/1983 | Roston | 5/431 X |

FOREIGN PATENT DOCUMENTS

| | | | |
|---|---|---|---|
| 2454782 | 12/1980 | France | 5/436 |

*Primary Examiner*—John E. Murtagh
*Assistant Examiner*—Richard Chilcot
*Attorney, Agent, or Firm*—Arnold, White & Durkee

[57] ABSTRACT

An infant seat for holding low birth weight neonates which supports an infant in such a manner as to prevent most position-induced deformities from occurring. The seat includes a head-receiving cavity, a back-supporting region and a buttocks-receiving hollow; a leg-containing structure is disposed on each side of the hollow. The back-supporting region is configured to hold an infant in a supine position and includes an arcuate surface on each side for biasing a supported infant to remain in the supine position. The head-receiving cavity is designed to not only maintain the infant's head in alignment with the infant's back, but also engages the infant's head over a large semi-spherically area to prevent flattening of the skull. The leg-containing structure prevents the infant's legs from flailing outwardly away from the infant's body, thus reducing hip rotation deformities and abduction stress in the leg and hip joints of the infant.

16 Claims, 6 Drawing Figures

Fig. 1
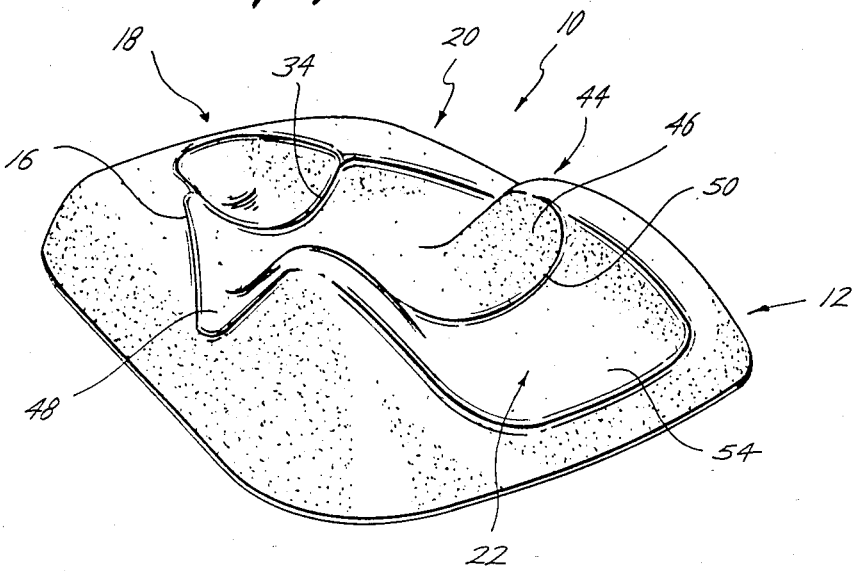
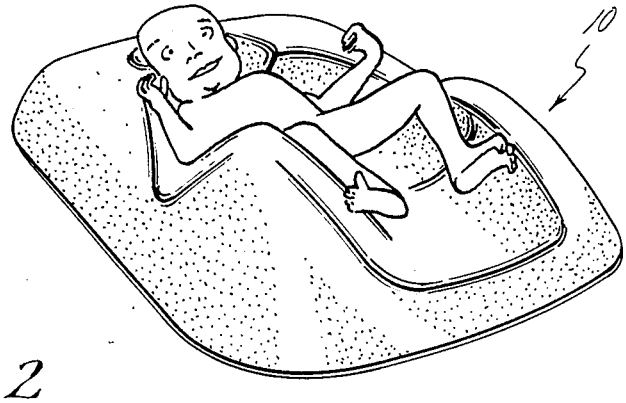
Fig. 2

NEONATAL INFANT SEAT

BACKGROUND OF THE INVENTION

1. Field of the Invention

This invention relates to an infant seat specifically designed for holding low birth weight neonates in such a fashion to prevent position-induced deformities. The infant seat hereof effectively positions the head of a neonate for ease of breathing and positions the limbs to prevent abduction stress in the infants joints.

2. Description of the Prior Art

As those familiar with premature babies, particularly low birth weight neonates, are aware, many life threatening considerations are present in the care of such neonates. Therefore, it is not surprising that preventing position-induced deformities is often not an immediate consideration. Typically, such a neonate is laid on a generally flat mattress, normally in a supine position. Neonates, particularly low birth weight neonates, usually lack the muscle tone and control to adequately support their head and limbs relative to their torso. Therefore, when the neonate is positioned on a flat mattress, the head and limbs generally flail in a haphazard fashion relative to the infant's torso. This problem of flailing of the limbs creates a tendency of the limbs to assume a particular position relative to the torso, which is usually a position which imposes unwanted abduction stress in the infant's joints.

As can be appreciated, this flailing of the limbs and the tendency of the limbs to assume unnatural positions, is undesirable from an orthopedic standpoint. For example, with the infant lying in a generally supine position on a flat mattress, the legs of the infant tend to rotate outwardly towards contact with the mattress. This outward rotation of the legs can induce abduction contractures of the hips and also external rotation deformities of the associated soft tissues. Further, when lying on a flat mattress in a supine position, the neck of the infant will tend to contact the mattress so as to produce a curved, somewhat constricted tracheal passage. Of course, a curved tracheal passage is undesirable in that it makes breathing more laborious. Additionally, supporting an infant's head on a generally flat mattress allows the head to rotate to one side, putting undesirable stress on the upper vertebrae of the spinal column. Also, at birth the skull of the neonate is sufficiently soft and deformable to develop flat spots to conform to the flat mattress.

Of course, many examples exist of deformities and other disadvantages associated with supporting a low birth weight neonate on a generally flat mattress. If ignored, these orthopedic deformities constitute additional problems and conditions which must be corrected at some stage in the development and care of the infant.

Infant seats have been devised in the past which are designed to support an infant in a sitting position. These seats are typically designed for infants or neonates who lack the muscular structure to adequately support themselves in a sitting position. However, such seats are not designed to prevent position-induced deformities in the low birth weight neonate.

Therefore, it would be a significant advance in the care and treatment of low birth weight neonates if a seat were designed which supported the neonate while minimizing position induced deformities and positioning the tracheal passage for easy breathing.

SUMMARY OF THE INVENTION

The infant seat of the present invention is particularly designed for holding and supporting low birth weight neonates in such a fashion as to prevent or minimize most position-induced deformities. Thus, the infant seat of the present invention positions the neonate's head in midline with the torso to prevent stress in the upper spinal column and to optimally position the infant's tracheal passage for ease of breathing. Further, the seat is designed to prevent skull flattening, to prevent external tibial and femoral torsion, and external rotational deformities of the soft tissues of the hip and knee joints. To the contrary, the seat hereof retains the infant's legs relative to the torso to introduce a slight flexion and adduction of the hip joints. The infant seat is preferably designed as a free standing structure for supporting the neonate generally horizontally in a supine position. It will be understood that the free standing seat can be upwardly inclined out of the horizontal to encourage visual stimulus and alertness or for feeding and care.

Broadly speaking, the infant seat of the present invention comprises a free standing pad adapted to support the infant in a generally supine position. The pad presents a number of undulations which rise upwardly and downwardly relative to a horizontal reference plane passing through the pad. The undulations define a number of structural features, any one of which is novel; in a preferred seat of the present invention the features are all included. Thus, the pad preferably includes a downwardly cupped, head receiving cavity adjacent a torso-engaging means. An upwardly raised, neck-supporting cusp is located between the torso-engaging means and the head receiving cavity, with the cavity, cusp, and torso-engaging means preferably disposed along a central axis of the pad. The torso-engaging means operates to bias the infant towards a supine position and preferably includes a back supporting region adjacent the neck supporting cusp and an arcuate buttock-receiving hollow proximate to the back supporting region. An upwardly projecting leg-containing structure is located on each side of the buttocks-receiving hollow, laterally spaced from the central axis, while an upwardly-oriented, knee supporting ridge is disposed along the central axis adjacent the buttocks-receiving hollow. An inclined calf and foot supporting area extends downwardly and away from the knee supporting ridge along the central axis.

Preferably, the head-receiving cavity is arranged in a semi-spherical configuration for engaging the infant's head over a concaval area to inhibit flattening of the infant's head at any one spot. The head receiving cavity is designed to position the infant's head in midline with the torso, while the neck supporting cusp positions the infant's tracheal passage for easy breathing. The back supporting region preferably includes an arcuate surface which contacts the shoulder regions of the infant to bias the infant to remain in the supine position. The buttocks-receiving hollow is preferably semi-spherical and in conjunction with the leg-containing structure retains the infant's hips and femurs in general alignment with the infant's torso, thus preventing the infant's legs from flailing outwardly away from the infant's body. Preferably, arm-receiving means adjoins the back supporting region and extends outwardly and away from the back supporting region to allow movement of the infant's arm while providing arm support when necessary.

BRIEF DESCRIPTION OF THE DRAWINGS

FIG. 1 is a perspective view of the infant seat of the present invention;

FIG. 2 is a perspective view of the infant seat with a neonate supported therein;

DESCRIPTION OF THE PREFERRED EMBODIMENT

Turning now to the drawings, the infant seat 10 in accordance with the present invention broadly includes a pad 12 having a lowermost, generally flat bottom 14 and an uppermost child supporting undulated surface 16. In the preferred embodiment, the pad 12 is composed of a resilient, compressible inner core covered by an outermost resilient, imperforate covering such that the pad is somewhat yieldable under the weight of an infant while the outermost imperforate covering makes the seat 10 generally urine-proof, odor-proof and stain resistant. As shown in FIG. 2, the seat 10 was generally designed for supporting the newborn infant, with the seat 10 particularly useful for supporting the low birth weight neonate (approximately less than 2500 grams at birth). Advantageously, the seat 10 is of such a size to easily fit in an incubator or the like.

Figure 3:
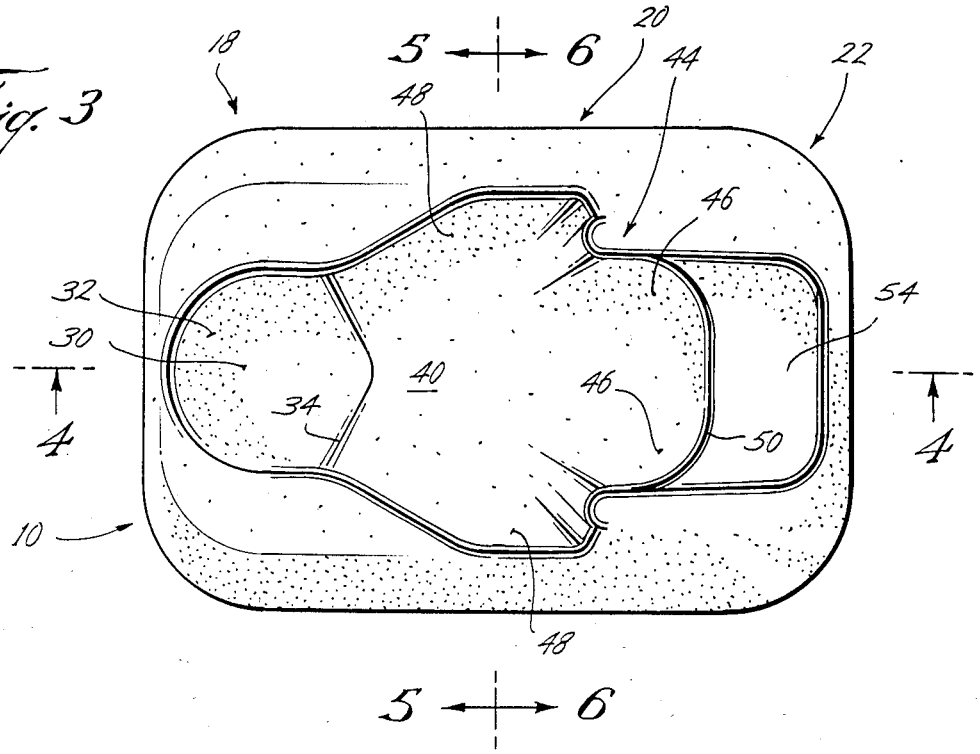
FIG. 3 is a top plan view of the infant seat hereof.

Broadly speaking, the seat 10 includes head receiving means 18, torso engaging means 20, and foot supporting means 22 (FIG. 1). As shown in FIG. 3, the undulated surface 16 presents a generally elongated infant supporting region. For reference purposes, a longitudinal, central axis is generally defined along the section taken along line 4—4 of FIG. 3. For purposes of description, the seat 10 is assumed to be generally horizontally oriented, it being understood that the seat 10 is positionable in a variety of orientations.

The head-receiving means 18 generally includes a downwardly cupped, cavity 30 proximate to one end of the pad 12 and disposed along the central axis. As shown particularly in FIGS. 3–5, the cavity 30 includes downwardly converging side walls 32 arranged in a semi-spherical configuration. Adjacent to the cavity 30 along the central axis, is an upwardly-raised neck supporting cusp 34.

Figure 4:
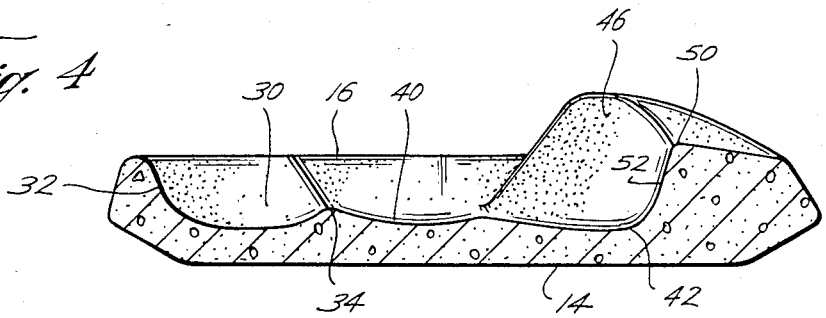
FIG. 4 is a vertical sectional view taken along line 4—4 of FIG. 3.

The torso-engaging means 20 generally includes a back-supporting region 40 which extends from the cusp 34 in a longitudinally arcuate fashion (see FIGS. 3–4). As can be seen from the drawing, particularly FIG. 3, arm-receiving means 48 adjoins the back-supporting region 40 and extends outwardly and away from the back-supporting region. Further, the torso-engaging means 20 includes a downwardly-extending arcuate buttocks-receiving hollow 42 adjoining the back supporting region 40 and disposed along the central axis. Containment means 44, located adjacent the hollow 42, includes an upright surface 46 on each side of the buttocks-receiving hollow laterally spaced from the central axis.

The foot supporting means 22 presents an upwardly-oriented, knee supporting ridge 50 connected to the hollow 42 by an arcuate upright thigh-engaging surface 52 (see FIG. 4). A calf and foot supporting area 54 extends downwardly away from the knee supporting ridge 50 as illustrated in FIGS. 1, 3 and 5.

In use, the neonate is positioned in the seat 10 in a generally supine position as shown in FIG. 2. It will be appreciated that seat 10 is generally self-supporting and positionable either on a conventional bed or in an incubator (as might typically be the case). The seat 10 is designed to be free standing for support in a generally horizontal orientation. However, the seat 10 is equally adapted to be upraised at an angle out of the horizontal, which might be useful, for example, during periods of infant alertness, feeding or examination.

With the infant received in a generally supine position as in FIG. 2, the head receiving means 18, in cooperation with the torso engaging means 20, generally aligns the head of the infant along the midline or spinal column of the infant. The semi-spherical configuration of the cavity 30 prevents rotation of the infant's head outwardly to one side preventing rotational stress in the upper vertebra. Further, the semi-spherical configuration supports the head over a large arcuate surface area which substantially eliminates flattening of the skull in one small region as is often encountered with a flat mattresses. The upstanding neck-supporting cusp 34 engages the infant's neck so as to position the infant's tracheal passage for ease of breathing. Thus, the infant's head is not rotated forward, as is often the case with flat mattresses, which tends to restrict or reduce the overall cross-sectional area of the tracheal passage thereby inhibiting breathing.

Figure 5:
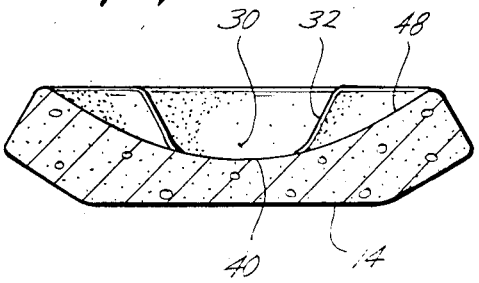
FIG. 5 is a sectional view taken along line 5—5 of FIG. 3.
Figure 6:
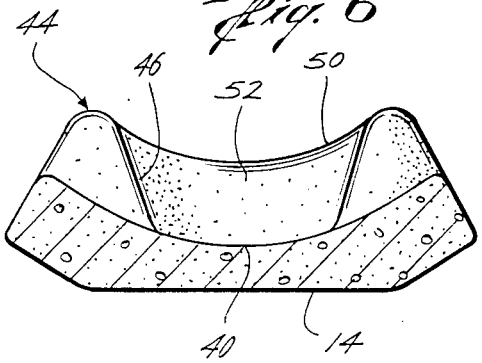
FIG. 6 is a vertical sectional view taken along line 6—6 of FIG. 3.

As perhaps best shown in FIGS. 5–6, the back-supporting region 40 is transversely arcuate in cross section and, in conjunction with the arm receiving means 48, serves to bias the infant to remain in the supine position. As position-induced deformities are not typically encountered in a neonate's arms, the arm receiving means 48 are designed to support the infant's arms during periods of inactivity, and yet allow freedom of movement of the arms.

The buttocks-receiving hollow 42 is slightly curved longitudinally along the central axis to accommodate infants of varying torso lengths. Advantageously, the hollow 42 and containment means 44 cooperate to prevent the infant's legs from flailing outwardly away from the torso. Thus, external rotation deformities of the surrounding soft tissue and the femurs are decreased or eliminated. The knee-supporting ridge 50 and thigh-engaging surface 52, in conjunction with the hollow 42, cooperate to induce slight flexion and adduction of the hips which tends to prevent abduction contracture type deformities in the infant. The calf and foot supporting area 54 is generally arcuate in transverse cross section which tends to retain the infant's feet along the infant's midline preventing outward flaring of the infant's legs and feet. Further, the calf and foot supporting area 54 extends downwardly and away from the knee supporting ridge 50 to support the infant's calf and feet in a natural position while introducing slight flexion in the knees and ankles.

As can be appreciated from the above discussion, the infant seat 10 of the present invention is particularly designed and adapted to support the low birth weight neonate in such a fashion to inhibit position-induced orthopedic deformities. Further, the infant is supported in a supine position in such a fashion that breathing is easier and mental alertness is encouraged. The infant seat 10 of the present invention presents many advantages for the care and treatment of infants, particularly low birth weight neonates, in that orthopedic deformities are reduced thereby reducing the necessity of follow-on orthopedic treatment.

We claim:

1. A neonatal infant seat comprising:

a pad adapted to support a neonatal infant in a generally supine position, the pad having a central axis and a number of undulations disposed upwardly and downwardly relative to a generally horizontal reference plane passing through the pad, the pad including a downwardly cupped, head-receiving cavity disposed proximate to one end of the pad along the central axis and configured to support the infant's head without impinging on the infant's ears and without flattening the infant's skull, an upwardly-raised, neck-supporting cusp located adjacent the head-receiving cavity along the central axis to support the infant's neck to allow unrestricted breathing, a descending back-supporting region disposed adjacent the neck-supporting cusp along the central axis, the back-supporting region being arcuate in cross-section transverse to the central axis, upraised arm-receiving structure adjacent the back-supporting region in spaced relation on each side of the central axis, the arm-receiving structure and back-supporting region cooperating to broadly support the infant without the formation of decubidy, and to provide unrestrained arm movement while biasing the infant into the supine position, a downwardly-extending, arcuate buttocks-receiving hollow adjoining the back-supporting region and located along the central axis, an upwardly-projecting, leg-containing structure located on each side of the buttocks-receiving hollow laterally spaced from the central axis, an upwardly-oriented, knee-supporting ridge disposed along the central axis adjacent the buttocks-receiving hollow, and a downwardly-inclined, calf and foot supporting area proximate to the knee-supporting ridge along the central axis.

2. The seat according to claim 1, wherein the pad includes an outermost substantially imperforate surface.

3. The seat according to claim 1, wherein the pad is formed of a resilient, compressible material.

4. The seat according to claim 1, wherein the back-supporting region includes an arcuate surface transverse to the central axis to bias the infant towards the supine position.

5. The seat according to claim 1, wherein the head-receiving cavity includes converging sidewalls arranged in a semi-spherical configuration for engaging the infants head over a concave area to inhibit flattening of the infant's head.

6. The seat according to claim 1, wherein the leg-containing structure is configured to prevent the infant's legs from flailing outwardly, horizontally away from the buttocks-receiving hollow to inhibit hip rotation deformities.

7. A neonatal infant seat adapted to support a neonate without restraint in a generally horizontal orientation in such a manner as to avoid position-induced deformities, the seat comprising:

torso-engaging means for supporting the torso of the neonate with the neonate in a generally supine position and having structure for biasing the neonate to remain in the supine position without active restraint, the torso-engaging means being arcuate to generally conform and broadly support the neonate's back and buttocks to inhibit the formation of bed sores, the biasing structure being operable to allow freedom of the arms and shoulders, head-receiving means for positioning the neonate's head in general alignment with the torso of the neonate to provide unrestricted breathing, the head-receiving means being cupped to generally conform to the neonate's head to inhibit skull deformities; and neck-supporting means, located between the torse-engaging means and head-receiving means for supporting the neonate's neck relative to the neonate's head to position the neonate's tracheal passage for ease of breathing.

8. A neonatal infant seat according to claim 7, wherein the torso-engaging means includes a back-supporting region and a buttocks-receiving hollow.

9. A neonatal infant seat according to claim 8, wherein the back-supporting region includes an arcuate surface for contacting the shoulder regions of a supported infant to bias the infant to remain in a supine position.

10. A neonatal infant seat according to claim 8, wherein the buttocks-receiving hollow includes a semi-spherical structure for retaining the infant's hips and femurs in general alignment with the infant's torso.

11. A neonatal infant seat according to claim 7, wherein the torso-engaging means includes containment means for preventing the infant's legs from flailing outwardly away from the infant's body.

12. A neonatal infant seat according to claim 8, including arm-receiving means, adjoining the back-supporting region, for allowing movement of the infant's arms and including arm support structure extending outwardly and upwardly relative to the back-supporting region.

13. A neonatal infant seat adapted to support an infant in a generally horizontal position in such a manner to avoid position-induced deformations, the seat comprising:

torso-engaging means for biasing the infant towards a supine position and having disposed along a central axis an arcuate back-supporting region and a rounded, buttocks-receiving hollow to conformingly support the infant's back and buttocks;

arm-receiving means adjoining the back-supporting region remote from buttocks-receiving hollow, the arm-receiving means including support structure on each side of the back-supporting region, the structure extending outwardly and upwardly relative to the back-supporting region for allowing movement of the infant's arms to decrease abduction in the infant's shoulders and arms:

containment means adjacent the buttocks-receiving hollow for preventing the infant's legs from flailing horizontally outwardly-away from the central axis, the containment means including upright structure on each side of the buttocks-receiving hollow; and foor-supporting means proximate to the buttocks-receiving hollow and disposed along the central axis for supporting the infant's feet and a portion of the infant's legs above the infant's buttocks, the buttocks receiving hollow being angled to support the thigh portions of the infant's legs upwardly away from the infant's torso proximate to the central axis, and the foot-supporting region being configured to support the calf portions of the infant's legs angled downwardly away from the infant's knees, the hollow and foot-supporting means cooperating for introducing some flexion in the infant's hip joints to decrease abduction stress in the hip joints.

14. A neonatal infant seat according to clam 13, including head-receiving means for positioning the infant's head in general alignment with the torso of the infant.

15. A neonatal infant seat according to claim 13, including neck-supporting means for supporting the infant's neck in a comfortable breathing position.

16. A neonatal infant seat according to claim 13, the foot-supporting means including a generally flat, upraised portion which descends downwardly in a direction away from the buttocks-receiving hollow.

* * * * *